United States Patent [19]

Hayner

[11] 4,088,059

[45] May 9, 1978

[54] METHOD AND APPARATUS FOR CONTROLLING AND UTILIZING RECOIL

[75] Inventor: Paul F. Hayner, Gilford, N.H.

[73] Assignee: Sanders Associates, Inc., Nashua, N.H.

[21] Appl. No.: 765,706

[22] Filed: Feb. 4, 1977

[51] Int. Cl.[2] ..... F41F 19/14

[52] U.S. Cl. ..... 89/43 A; 89/42 B

[58] Field of Search ..... 89/42 B, 43 A

[56] References Cited

U.S. PATENT DOCUMENTS 3,566,740 3/1971 Williams et al. ..... 89/43 A

OTHER PUBLICATIONS

Gilbert J. Melow, Jr., Ordnance, "New Trends in Artillery", vol. LIII, No. 291, Nov.-Dec., 1968, pp. 282-285.

*Primary Examiner*—Stephen C. Bentley

*Attorney, Agent, or Firm*—Louis Etlinger; Robert K. Tendler

[57] ABSTRACT

A method and apparatus for controlling the runout and initial recoil velocity of an artillery piece is disclosed in which variables of barrel elevation and the impulse delivered by a round of ammunition are hydraulically sensed as pressures trapped in actuators which control the flow of fluid to the recoil cylinders of the artillery piece. The system provides for a predetermined constant deceleration of the recoiling barrel assembly regardless of the type or power of the round utilized. When a constant predetermined deceleration is provided, the recoil velocity is uniquely determined and an automatic system is provided for assuring that the loading of the artillery piece always takes place at the same instant of time and that the barrel assembly will have decelerated sufficiently to prevent damage to the snubbing apparatus carried by the artillery piece.

38 Claims, 6 Drawing Figures

METHOD AND APPARATUS FOR CONTROLLING AND UTILIZING RECOIL

FIELD OF THE INVENTION

This invention relates generally to artillery, that is, to guns larger than those intended to be transported and operated by one man and particularly to apparatus for controlling and using the energy associated with the recoil of the barrels of such guns to control the recoil and runout of the gun barrel.

BACKGROUND OF THE INVENTION

Large caliber guns of the kind of interest for present purposes generally include a frame which enables azimuth and elevation to be adjusted and which frame, during firing, is held stationary. Normally, the barrel of the gun is mounted for limited axial movement relative to the frame so that, upon firing, the gun barrel recoils and moves backward relative to the frame. Before the gun can be fired again, the backward movement must be stopped, the gun must be reloaded, and the barrel returned to its forward, firing position.

The firing of a gun releases a great deal of energy some of which inevitably appears as the kinetic energy of the rearward motion or recoil of the gun barrel and associated parts which move with the gun barrel. When referring to the gun barrel, hereinafter this generally refers to the barrel and all parts which move with the barrel, e.g. the gun barrel assembly. In order to stop the rearward motion of the gun barrel assembly, the kinetic energy must be dissipated and/or stored and/or utilized, and equipment for these purposes is normally provided. Such equipment may vary widely in kind and complexity. One arrangement includes a pair of hydraulic cylinders and pistons with one element of each, for example, the cylinders, fastened to opposite sides of the gun barrel while the other elements, in this case, the pistons, are fastened to the frame. Hydraulic circuitry connects the cylinders to an accumulator so that, during recoil, fluid from the cylinders flows to the accumulator thereby storing the energy of recoil. This equipment may be supplemented by snubbers such as springs, rubber bumpers, dash pots and the like. The stored energy may be used to reload the gun and/or to return it to its firing position.

Equipment such as that briefly described above has been widely used but has been subject to a number of disadvantages. It is highly desireable that the velocity of recoil, or backward movement of the gun barrel be within a predetermined range of velocity when the gun barrel reaches its "sear" position so as to establish the loading cycle as well as prevent damage to the snubbing device. Loading generally takes place simultaneously with the snubbing.

However, with the equipment used in the past this velocity has tended to vary widely because of the many variables involved. For example, different kinds of ammunition which may be used with a gun cause different recoil forces to be generated. Additionally, the amount of charge varies from unit to unit of ammunition of the same kind due to normal variations in the manufacturing process. The elevation of the gun barrel also affects the forces involved. A further complication is that sometimes the gun may be fired from "runout" where it has a forward velocity while at other times it may be fired from "battery" where the gun is stationary. Obviously, these two situations cause different forces to be exerted on the recoil pistons. Another related problem is that of controlling "runout" or the return of the gun barrel to its firing position in such a way that it will be moving at a preselected velocity when it reaches the firing position. This is necessary to establish a known initial velocity at the time of firing, so that the time of loading of the next round can be accurately set. Here again, variations in elevation cause variations in the forces which must be controlled.

SUMMARY OF THE INVENTION

Briefly stated, the invention includes the concept of measuring the elevation of the gun barrel and its initial rearward velocity immediately after firing and using these measurements to control the flow of fluid from the gun recoil cylinders to the accumulator so as to maintain the pressure on the recoil pistons at that proper substantially constant value which causes the gun barrel to decelerate at such a rate that its velocity is within predetermined limits when the gun reaches the sear position. Another feature is the method and apparatus for controlling the flow of fluid from the accumulator to the cylinders during runout so that the gun barrel is moving at a predetermined velocity when it reaches firing position. It is a feature of the subject invention that in one embodiment all measurements are taken hydraulically and that the pressures in the recoil cylinders are set automatically via a unique valve system, which automatically computes appropriate pressures and flow rates and in which the valves of which are set in real time in accordance with sensed hydraulic pressures.

More particularly, one specific embodiment of the invention comprises controlling the recoil of a gun barrel equipped with a hydraulic recoil piston and cylinder so as to cause fluid to flow therefrom during recoil to an accumulator by measuring the angle of elevation of the gun barrel, measuring the peak recoil velocity of the barrel after firing, computing the deceleration necessary to cause the barrel to have a predetermined velocity at a predetermined distance from the firing position, and controlling the flow of fluid from the cylinder to the accumulator so as to establish and maintain the above mentioned deceleration.

Thus, a method and apparatus for controlling the runout and initial recoil velocity of an artillery piece is disclosed in which variables of barrel elevation and the impulse delivered by a round of ammunition are hydraulically sensed as pressures trapped in actuators which control the flow of fluid to the recoil cylinders of the artillery piece. The system provides for a predetermined constant deceleration of the recoiling barrel assembly regardless of the type or power of the round utilized. When a constant, predetermined deceleration is provided, the recoil velocity is uniquely determined and an automatic system is provided for assuring that the loading of the artillery piece always takes place at the same instant of time and that the barrel assembly will have decelerated sufficiently to prevent damage to the snubbing carried by the artillery piece.

BRIEF DESCRIPTION OF THE DRAWINGS

For a clearer understanding of the invention reference may be made to the following detailed description and the accompanying drawings, in which.

DESCRIPTION OF PREFERRED EMBODIMENT

Figure 1:
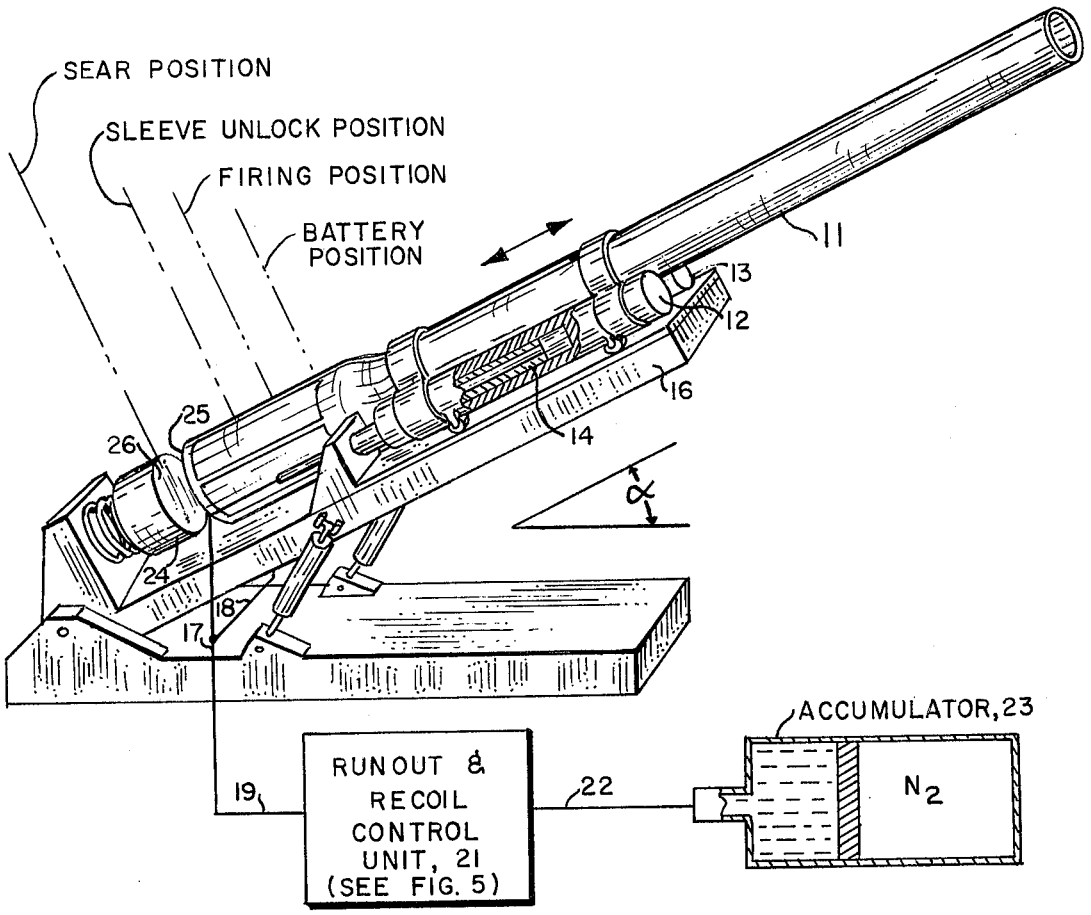
FIG. 1 is a schematic cross section diagram with portions in block form showing the relationship between the gun barrel, the recoil pistons and cylinders, the control circuits and the accumulator.

Referring first to FIG. 1, there is shown a gun barrel 11 assumed to be adjusted to some arbitrary angle, $\alpha$, above the horizontal. Two hydraulic recoil cylinders 12 and 13 are rigidly fastened to the gun barrel 11 on opposite sides thereof. Associated with these cylinders are pistons 14 and 15 (not shown in FIG. 1) which are fastened rigidly to the frame 16 of the gun. Hydraulic lines 17 and 18 communicate with the interior of the cylinders 12 and 13 respectively. These lines are connected together and to a line 19 which in turn is connected to a hydraulic runout and recoil control unit schematically indicated at 21. This control unit, in turn, is connected by a hydraulic line 22 to an accumulator 23, which is partially filled with nitrogen as illustrated.

The gun barrel 11, and the cylinders 12 and 13 are mounted to be moveable relative to the frame 16 along a line parallel to the axis of the gun barrel 11. The cylinders 12 and 13 and all of the hydraulic lines are filled with a fluid so that if the gun barrel 11 moves rearwardly, which is downward and to the left as viewed in FIG. 1, fluid will be expelled from the cylinders 12 and 13 through the hydraulic lines 17, 18, and 19 to the control unit 21 and then through the hydraulic line 22 to the accumulator 23. Conversely, if fluid is forced through these hydraulic lines into the cylinders 12 and 13, the gun barrel 11 will be urged forward, that is, upward and to the right as viewed in FIG. 1. The gun is shown in an intermediate position. When it recoils, or moves rearward further, it engages a snubbing mechanism 24 which yields, stops the rearward motion, and returns the gun barrel so that its lower end 25 is substantially flush with the top 26 of the snubbing mechanism 24.

Figure 2:
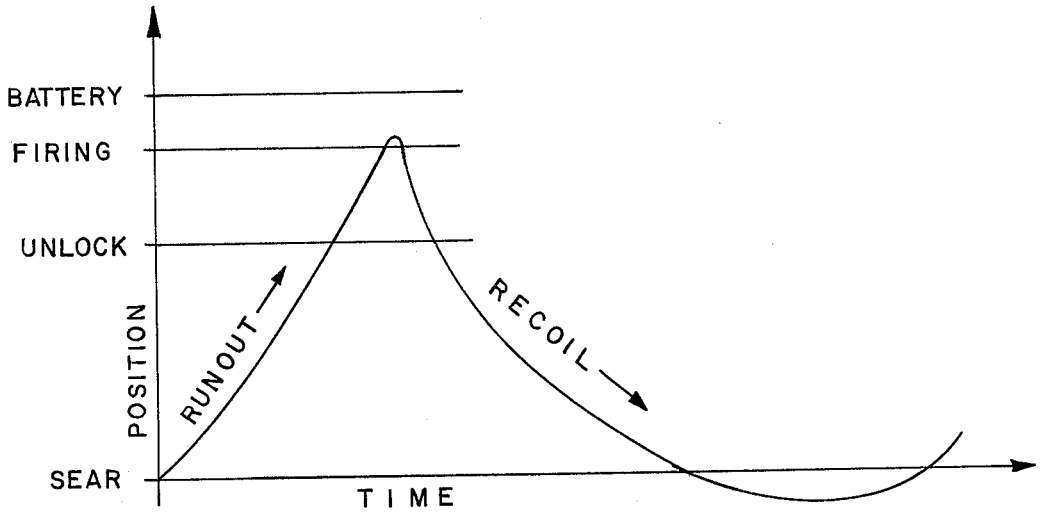
FIGS. 2 and 3 are each graphs useful in explaining the invention.

Referring now to FIG. 2, there is shown schematically a typical firing cycle of the gun. It is assumed that the gun has started at the sear position, that is with the end 25 of the gun barrel resting on top of the snubber 24. It is also assumed that the gun has been loaded with ammunition. The gun is advanced normally by admitting fluid to the cylinders 12 and 13, until it reaches the firing position whereupon the gun is fired automatically, for example, by means of a switch actuated by the gun barrel when it reaches the desired firing position. Firing of the gun rapidly reverses the direction of travel of the gun barrel which recoils through the firing position and then to a "sleeve unlock" position where the sleeve is unlocked so that the gun may be reloaded. The gun continues to recoil until it reaches the sear position where it engages the snubber which absorbs the remaining recoil motion, reverses the direction and returns the gun to the sear position. While in or near the sear position, the gun is reloaded either manually or automatically.

Each gun installation has its individual known starting parameters and its own various requirements as to velocities, elapsed time, and the like. For example, it may be desired to use High Explosive (HE) ammunition and it may be known that such ammunition, when fired from a stationary gun, causes an initial impulse, or recoil velocity within a predetermined range, for example, in the range from 28.5 feet per second to 31.5 feet per second. It may also be desired to use Armor Piercing (AP) ammunition and it may be known that such ammunition, when fired from a stationary gun, generates an initial impulse velocity within a predetermined range, for example, in the range of from 25.2 to 22.8 feet per second. It may also be required that there be a minimum elapsed time (for example, 30 milliseconds) from the firing of the gun to the time it reaches the sleeve unlock position. A further frequent requirement is that the gun reach the sear position with a velocity falling within a certain range (for example, in the range from 4 to 10 feet per second). It is also almost a universal requirement that the gun be required to fire at various elevations. The above information and requirements, along with other known characteristics, such as the size of the pistons and cylinders, the weight of the recoiling mass and the distance between the various positions make it possible to calculate the necessary velocities and accelerations to meet the various requirements. In accordance with the invention, there has been computed $V_R$, the runout velocity, that is that forward velocity of the gun when it reaches the firing position, which is necessary for each kind of ammunition to provide the required initial velocity, $V_I$ which the gun must have in order to yield the required elapsed time between the firing and the reaching of the sleeve unlock position. In accordance with one feature of the present invention, there is next calculated that constant deceleration necessary to make the gun have the required velocity when it reaches the sear position. In accordance with the present invention, the flow of fluid from the cylinders is controlled to establish and maintain this constant deceleration.

Figure 3:
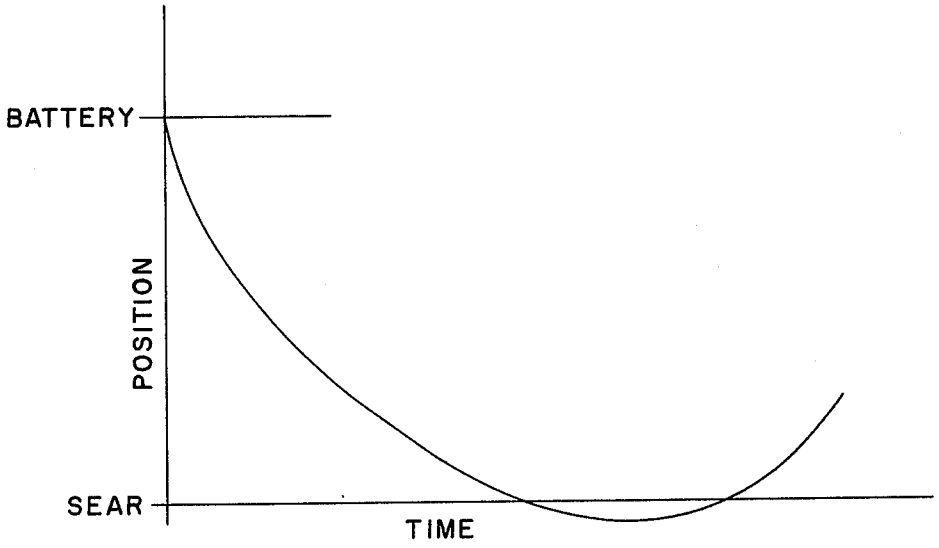

As previously mentioned, it is sometimes desired to fire the gun from "battery" position, that is, to fire it while it is stationary, but located at a position somewhat forward of the firing position at which it is fired from "runout". FIG. 3 shows a typical curve of the position of the gun as a function of time when it is fired from battery. The initial velocity is, of course, higher than if the gun had a forward velocity when fired, but this is compensated for in part by the greater distance the gun must travel before reaching sear position. As in the case of firing from runout, the present invention contemplates that when firing from battery a constant deceleration be established and that the flow of fluid from the cylinders to the accumulator be controlled so as to establish and maintain this constant deceleration to the end that the velocity of the barrel when it reaches sear position will be within the prescribed limits.

Figure 4:
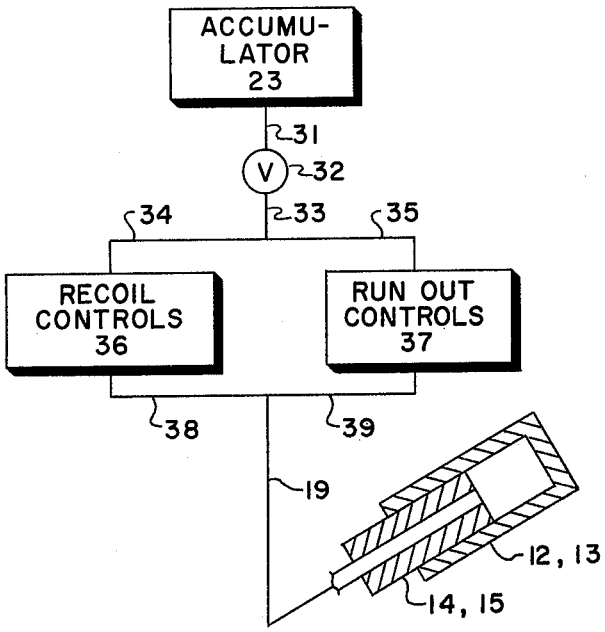
FIG. 4 is a block schematic diagram showing how the controls of the present invention are connected to the accumulator and the recoil cylinders and pistons.

Referring now to FIG. 4, the accumulator 23 is connected through a hydraulic line 31 to a valve 32 and then through another line 33 to a pair of lines 34 and 35. The latter lines are connected to the recoil control 36 and the runout control 37 of the present invention. These controls, in turn, are connected through conduits 38 and 39 respectively to the conduit 19 which, in turn, is connected to the interior of the cylinders 12 and 13.

Figure 5:
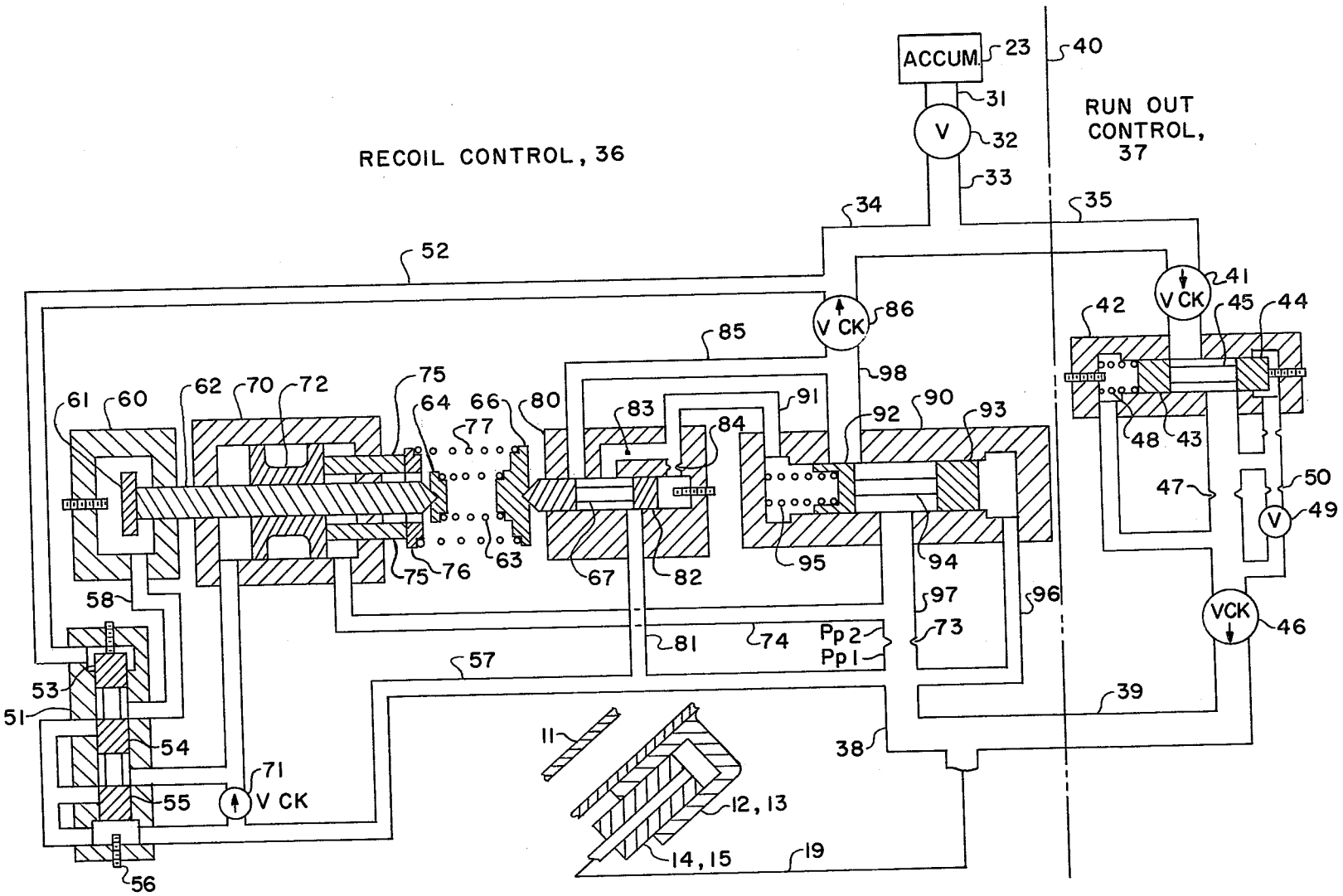
FIG. 5 is a schematic cross section diagram showing a preferred embodiment of the recoil and runout controls of the invention.

Referring now to FIG. 5, one embodiment of the runout and recoil controls of the present invention are shown. The equipment to the right of dash line 40 controls runout, while the equipment to the left controls recoil.

RUNOUT CONTROL

It will be appreciated that the first parameter which must be controlled is the runout so that when the gun barrel reaches its firing position it is traveling at a predetermined known velocity. This velocity is regulated so that the barrel will recoil with approximately the same initial recoil velocity regardless of the type of ammunition used. This also requires that the runout velocity be adjustable for the different types of rounds, since the Armor Piercing round requires a higher runout velocity to obtain a given initial recoil velocity than the high explosive round. In general, the runout control permits calculation of the appropriate recoil deceleration so each recoil will start from the same set of initial conditions. As will be explained hereinafter, the constant runout velocity also makes possible the sensing of gun barrel elevation. The predetermined runout velocity is obtained by noting that the rate of flow of fluid to the recoil cylinders, if made constant, results in a constant runout velocity.

Referring to the righthand side of FIG. 5, in which like elements in FIGS. 4 and 5 have like reference characters, fluid under pressure from accumulator 23 is applied through on/off valve 32 via a line 33, through a check valve 41 to a self-adjusting spool valve 42, comprised of lands 43 and 44 connected by a shaft 45. Fluid from the accumulator is applied through the center of valve 42, through a check valve 46, through line 39 to line 19 and thence to the recoil cylinders 12 and 13. The fluid flow rate in line 19 is regulated as follows:

The line from valve 42 to line 19 is provided with a restricted orifice 47, and in combination, valve 42 and orifice 47 determine the runout velocity by establishing a predetermined pressure differential across the orifice.

In general, the velocity of a piston is directly proportional to the rate of flow into the cylinder. In the subject system, if the rate of flow to cylinders 12 and 13 is made constant, the runout velocity will be constant. With a known predetermined flow rate, the runout velocity will be known and predetermined.

In the runout control of FIG. 5, the rate of flow through orifice 47 is directly proportional to the pressure drops across the orifice. To make the rate of flow constant, the pressure drop across orifice 47 is made constant by the action of valve 42. The force $F_1$, pushing the valve to the left is equal to $P_1$, the pressure above orifice 47, times the area, A, of land 44. The force $F_2$, pushing the valve to the right is equal to $P_2$, the pressure below orifice 47, times the area, A, of land 43 plus F spring, 48.

In operation, the spool of valve 42 will move until $F_1 = F_2$. Initially, before there is any flow of fluid through valve 42, $P_1 = P_2$ and spring 48 pushes the spool all the way to the right. As shown, valve 42 is wide open. When flow starts, $P_1$ is nearly the pressure of the accumulator and is applied to the righthand cavity of valve 42. At this time, there is a large flow through orifice 47 and a consequent large pressure drop is established. As valve 42 is pushed to the left, land 44 partially covers the outlet of the valve which increases the pressure drop across valve 42, thereby decreasing the rate of flow and the pressure drop across the orifice. Soon the pressure drop across orifice 47 is small enough so that $P_2A + F\,\text{spring} = P_1A$ and the spool stops. The size of orifice 47 and spring 48 are selected to the desired rate of flow which, in turn, corresponds to the desired velocity of cylinders 12 and 13 relative to pistons 14 and 15.

As mentioned, the runout velocity is made different for different types of ammunition so that the initial recoil velocity after firing will be as close to a uniform velocity as possible. To change the runout velocity, a valve 49 and a restricted orifice 50 are provided to vary the effective total orifice size.

Recoil Control

Once having achieved a constant known runout velocity within a predetermined small range, the recoil can be accurately controlled so that loading can take place at the proper instant of time and so that the snubber can be protected against too violent a recoil.

As pointed out earlier, in order for the appropriate pressure to be supplied to the recoil cylinders, certain variable parameters must be measured. The parameters are the elevation of the gun barrel and the initial velocity immediately after firing. Those parameters which do not change are the mass subject to recoil, friction, and the distance to be traveled between the firing position and the sear position.

In general, elevation is measured by the pressure of fluid trapped in an actuator 60 and initial velocity is measured in terms of the maximum or peak pressure of fluid trapped in an actuator 70. Thus, trapped pressures are utilized to sense the variable parameters.

These trapped pressures are translated into a reference pressure from a pilot valve 80, which in turn is applied to the recoil cylinders via a main regulator valve 90. Springs, to be described hereinafter, mechanically couple the output of actuator 70 to valve 80 to provide that a constant force is applied to the pilot valve regardless of the position of its spool. Main pressure regulator valve 90 controls the deceleration of the gun barrel during recoil via regulation of the fluid flow from the recoil cylinders so as to provide that the reference pressure is applied to the recoil cylinders during recoil. As will be seen, action of main valve 90 tracks the reference pressure produced by pilot valve 80, to give an adjustable deceleration pressure depending on the type and power of the round utilized as well as the particular gun elevation.

In order to provide an automatic system, the initial velocity must be specified, as well as elevation angle. If $v_o$, the initial velocity at the firing position can be sensed then in accordance with the classical formula:

$$d = v_o t + \tfrac{1}{2} a t^2$$

where $d$ = distance from firing position to the sear position
$v_o$ = initial velocity at the firing position
$a$ = deceleration
$t$ = time from firing to sear the velocity at the sear position can be controlled through the control of the acceleration "$a$" via control in the flow of the fluid from the recoil cylinders and this velocity can be made to be zero or some arbitrarily small velocity.

In order to achieve zero velocity at the sear position it is necessary to hydraulically measure elevation and initial velocity. The pressure to be supplied to decelerate the gun is this:

$$P_{PTOT} = P_{P(v_o)} + P_{P(\alpha)}$$

where $P_{p(v_o)}$ is a function of initial velocity and $P_{P(\alpha)}$ is a function of elevation, $\alpha$.

Even assuming a constant runout velocity, $v_o$ varies with the type of round, elevation of the gun, mass subject to recoil, and the distance from the sear position to the firing position. Thus, what varies is essentially the force or power of the charge and elevation, both of which are measured hydraulically, and the flow from the recoil cylinders is varied to maintain a constant predetermined deceleration pressure, regardless of elevation or ammunition, which, in turn, provides for a constant predetermined deceleration to keep the velocity of the barrel at the sear position within tolerable limits, usually between 4 and 10 ft./sec. This is accomplished as follows:

Elevation Measurement

It is the purpose of the elevation measuring apparatus to apply a pressure to the recoil cylinders which exactly counteracts the pressure created by the force of gravity on the gun barrel assembly. When this is done, the recoil is controlled solely by developing a pressure which will provide the correct deceleration in accordance with the sensed initial velocity. In order to obtain the correct pressure to counteract gravity, a high pressure output from accumulator 23 is coupled to a spool valve 51 via line 52 displacing the lands 53, 54 and 55 of the spool in a downward direction until the bottom of land 55 rests against variable stop 56. This allows fluid from cylinders 12 and 13 to flow via line 57 through the bottom of valve 51 across middle land 54 into line 58 and to an actuator 60 such that the fluid from cylinders 12 and 13 exerts pressure against land 61 of actuator 60 thereby pushing a piston 62 mechanically attached to land 61 to the right against a spring 63 with a force proportional to the elevation of the gun. It will be appreciated that with the gun in a horizontal position, the backpressure in line 57 will be at one level, whereas, if the gun is elevated, the backpressure in line 57 will be increased thereby pushing piston 62 to the right against spring 63.

While the gun is advanced during runout, it soon reaches a constant velocity so that the pressure against land 61 is substantially proportional to the elevation of the gun. It will be appreciated that at this time the backpressure is substantially only due to the elevation of the gun.

As shown, a piston 62 exerts pressure on spring 63 via an annularly notched plate 64 and that the other end of spring 63 cooperates with another annularly notched plate 66 which drives a piston 67 of pilot valve 80 to the right. As will be seen, the position of piston 67, in effect, controls the fluid pressure in the recoil cylinders of the gun by regulating fluid flow from the cylinders via the position of valve 90.

In general, the pressure $P_{P(\alpha)}$ to be applied to counteract gravity is a function of elevation such that:

$$P_{P(\alpha)} = \frac{M_G \times \sin \alpha}{A_p}$$

where $M_G$ is the mass of gun parts subject to recoil,
$A_p$ is the area of the recoil pistons, and
$\alpha$ is the elevation angle In order to obtain $P_{P(\alpha)}$, the pressure from the recoil cylinders due to gravitational force is applied to land 61 which transmits this pressure to the pilot piston. This opens up the pilot valve an additional amount such that the main valve is opened by that amount necessary to establish $P_{p\alpha}$ at the recoil cylinders. Note that the elevation pressure is trapped at its value prior to recoil.

Thus, the pressure on land 61 is $P_{P(\alpha)}$, and this pressure is preserved as $P_{P(\alpha trapped)}$. $P_{P(\alpha trapped)}$ is applied to an area equal to the pilot piston area. The pressure available at line 91 between the pilot and main valves will then have a component $P_{P(\alpha)}$, since the pilot valve acts as a regulator. The main valve functions as a regulator such that when the main valve is in equilibrium, the pressure on the righthand side of the valve is equal to that on the lefthand side of the valve. Thus, if $P_{P(\alpha)}$ exists on the lefthand side of valve 90, it also exists on the righthand side and in a line 96 coupled to the recoil cylinders.

Once the $P_{p\alpha}$ component is established in line 96, the effect of gravity on the gun barrel assembly is cancelled, and what remains is to add the $P_{P(v_o)}$ component to $P_{P(\alpha)}$ in line 96 to control the recoil. How $P_{P(v_o)}$ is developed is now described.

Initial Velocity Measurement

The other part of the force on the lefthand end of the pilot valve's spool assembly is proportional to $v_o^2$ and, this measures the initial velocity of the gun barrel assembly after firing. As will be seen, $v_o^2$ is measured in terms of the pressure differential across an orifice in the flow path from the recoil cylinder to the pilot valve. Thus, the other variable which is to control piston 67 in order to control the fluid pressure in the recoil cylinders is the initial velocity after recoil.

Initial velocity after recoil is established a few milliseconds after the gun is fired and occurs after the direction of travel of the gun has reversed. As previously mentioned, this pressure and, thus, this velocity, can vary due to difference in the rounds of ammunition as well as the types of ammunition used. The initial velocity after recoil is measured as follows:

As soon as the gun fires, the pressure in recoil cylinders 12 and 13 rises tremendously due to the recoil. This fluid under pressure operates in a number of ways. First, it repositions the spool assembly of valve 51 by moving the assembly in an upward direction. This traps the previously recorded elevation dependent pressure in actuator 60 by sealing line 58.

Also with the spool assembly of valve 51 in an upward position, the only passageway from line 57 to actuator valve 70 is through a check valve 71. It will be appreciated that actuator 70 includes a land 72 which is mounted for reciprocation both in the chamber of actuator 70 and axially along piston 62. After the firing of a round, the absolute maximum or peak pressure in cylinders 12 and 13 after firing is transmitted by the fluid from the cylinders through check valve 71 to the lefthand portion ofactuator 70. This is counterbalanced by pressure on the righthand side of the actuator.

The pressure on the righthand side of land 72 is derived as follows: When measuring initial velocity, this velocity (e.g. $v_o^2$) is proportional to the flow of fluid through a restricted orifice 73 in line 38. The pressure downstream of orifice 73 is labeled $P_{p2}$ and this pressure is applied via line 74 to the righthand side of land 72, while the flow on the lefthand side is equal to $P_{p1}$, namely, the pressure within the recoil cylinder which is applied through check valve 71 to the lefthand side of land 72. It will be appreciated that land 72 is therefore moved in accordance with the pressure drop across restricted orifice 73, which is proportional to the flow through orifice 73, which, in turn, is proportional to the velocity of the piston which is afixed to the gun. The positioning, therefore, of land 72 is a direct result of the maximum pressure drop across restricted orifice 73 which is proportional to the velocity of the gun immediately after the gun is fired. This pressure is trapped by means of check valve 71 so that even if $P_{p2}$ subsequently increases or decreases, it would not be able to push land 72 to the left. Therefore, land 72 is trapped at the highest pressure drop and, therefore, measures the initial velocity of the gun just after firing. This pressure is sensed via the position of land 72 communicated through linkages 75 and an annular 76, through a spring 77, and disc 66 to piston 67 of pilot valve 80.

It can be shown that the orifice 73 area $$A_o = \frac{2\,A_1}{A_p \cdot K_x \cdot A_2 \cdot M_G}$$

where $M_G$ is the mass of the moving parts of the gun in slugs, $A_p$ is the gun hydraulic actuator area, $K_x$ is an orifical flow constant (100 in one case), $A_1$ is the area of land 72 and $A_2$ is the area of land 82 (pilot piston area). In one operative embodiment, the diameter of orifice 73 is 0.7188 inch. This accommodates typical operating conditions as given in Table I.

TABLE I

| | | TYPICAL PARAMETERS | | | | |
|---|---|---|---|---|---|---|
| Ammunition | Impulse Velocity | Initial Peak Recoil Velocity | Initial Peak Flow "$\frac{3}{8}$ | $P_{P_1}$ Pressure PSI | P $P_{P_1} - P_{P_2}$ | Velocity Sear |
| H.E. | 31.5ft/sec | 22.23ft/sec | 608 | 2248 | 224 | 7.22 |
| H.E. | 28.5ft/sec | 19.23ft/sec | 526 | 1682 | 168 | 6.23 |
| A.P. | 25.2ft/sec | 18.6ft/sec | 509 | 1573 | 157 | 6.03 |
| A.P. | 22.8ft/sec | 16.2ft/sec | 443 | 1194 | 119 | 5.24 |

H.E. = high explosive
A.P. = Armor Piercing

It will be appreciated that the mechanical pressure on the lefthand side of valve 80 must be equal to the hydraulic pressure on the righthand side in order for the piston to remain stationary. In the balancing, pressure is supplied from line 52 via line 81 to the middle of valve 80 and thence to the lefthand side of a land 82 connected at the righthand end of piston 67. It will be appreciated that the pressure in line 81 is also applied via internal passageway 83 through a restricted orifice 84 to the righthand side of spool 82.

Fluid flows from line 57 through valve 80 through a line 85 and through a check valve 86 into accumulator 23 so as to provide a pressure drop across land 82 as the fluid flows from pistons 12 and 13 to the accumulator. Mechanical pressure on the left of valve 80 is balanced by the hydraulic pressure on the righthand side.

For example, the pressure on the righthand side of land 82 becomes higher than the mechanical force on the left, the piston 67 of valve 80 will move to the left thereby cutting down the opening at the top of line 81, while at the same time opening line 85 which is the line to the accumulator. This decreases the pressure which is applied through internal passageway 83, which results in the cessation of movement of piston 67 to the left.

Assuming the pressure on the right of valve 80 is too small, this means that the piston will move to the right, thereby opening the passageway at the top of line 81 which increases the pressure applied to the righthand side of land 82. At equilibrium, valve 80, therefore, develops a reference pressure proportional to $v_o^2$ and $\alpha$, the elevation.

It will be appreciated that what is necessary is a reference pressure which is made up of factors involving elevation, initial velocity, mass, and distance. All that is necessary, therefore, is to convert the reference pressure into a suitable constant force to retard the motion of the pistons of the gun. It will be appreciated that if the retarding force is constant, the deceleration of the gun will be constant, and, thus, the velocity at sear can be readily calculated and controlled in accordance with the above formula.

The production of a pressure which will yield this constant retarding force is accomplished by main regulator valve 90 which, in effect, tracks the reference pressure established by pilot valve 80, and establishes a pressure equal to the reference pressure upstream of orifice 73, so that the reference pressure is applied to the recoil pistons. The reference pressure, mentioned hereinbefore, is established in a line 91 which couples valve 80 to valve 90. Valve 90 is a spool valve having a land 92 at the lefthand end and a land 93 at the righthand end with the lands being interconnected by a shaft 94.

The reference pressure established at the righthand end of valve 80 is applied to the lefthand side of spool 92, urging it in a righthand direction. Also urging spool 92 in a righthand direction is a soft spring 95 which urges the spool assembly to the right if there is no pressure whatsoever. However, compared to the pressures involved during normal operation of the unit, spring 95 is sufficiently soft so that the pressure at the righthand end of valve 90 may be regarded as substantially equal to the expected reference pressure.

It will be noted that the pressure at the righthand end of valve 90 is the pressure in the cylinders 12 and 13 as delivered by line 96 which is connected to line 19 as shown. It will be further appreciated that the pressure at the righthand side of land 93 is the pressure in the recoil cylinders and is the pressure which it is necessary to hold constant and to make equal to the reference pressure at the lefthand side of this valve.

Again looking at the operation of valve 90, if the pressure at the right of valve 90 is too small, the spool assembly will be moved to the right, thereby cutting down the flow across land 92 to the accumulator via line 98, thereby increasing the pressure $P_{p1}$ at the lower end of orifice 73.

If, however, the pressure from the righthand side of valve 90 becomes too great, the spool assembly will move to the left thereby opening this valve and causing an increased flow to the accumulator. This results in the reduction of the pressure on the righthand side of valve 90 and the reduction in the pressure on the pistons.

The result is that the pressure on the pistons is held substantially constant and at the appropriate value so that the gun moves with a constant deceleration which is computed so as to make its velocity, when it reaches the sear position, fall within the aforementioned predetermined range.

In the automatic system described, for a horizontal gun, with $d = v_o t + \frac{1}{2} at^2$, since it will be appreciated that $t = v_o/a$, and that $$a = \frac{\text{Force}}{\text{Mass}} = \frac{P_p A_p}{M_G},$$

where:

$P_p$ = recoil piston pressure $A_p$ = recoil piston area $M_G$ = mass of the gun parts subject to recoil it can be shown that the desired piston pressure $P_{p(v_o)D}$, to bring Mass $M_G$ to zero velocity at sear is:

$$P_{p(v_o)D} = \frac{v_o^2 M_G}{2A_p(d)}$$

$$\text{Since} \quad Q_F = K_o A_o \sqrt{P_p - P_{p2}} = v_o A_p$$

where $Q_F$ is orificial flow, $A_o$ is the flow sensor orifice area, and $P_{p2} - P_{p1}$ is the differential pressure across the flow sensor orifice, with respect to the initial velocity $v_o$, it can be shown that the controlled pressure:

$$P_{p(v_o)C} = \frac{A_p^2 v_o^2}{K_o^2 A_o^2} \cdot \frac{A_1}{A_2}$$

where $A_1$ = pilot stage input actuator (72) area $A_2$ = pilot piston (82) area This is true because $P_{p(v_o)C} = (P_{p1} - P_{p2}) A_1/A_2$ by virtue of the automatic action of the regulator piston. Thus, $P_{p(v_o)C}$ is set in accordance with $(P_{p1} - P_{p2})$ which, in turn, measures $v_o$, e.g.

$$P_{p1} - P_{p2} = \frac{v_o^2 A_p^2}{K_o^2 A_o^2}$$

Since $P_{p(v_o)C}$, the controlled pressure, must equal $P_{p(v_o)D}$, the desired piston pressure, to decelerate $M_G$ to zero at the sear position, $$v_o^2 \cdot \frac{A_p^2 A_1}{K_o^2 A_o^2 A_2} = v_o^2 \cdot \frac{M_G}{2A_p(d)}$$

$v_o 2$ cancels from the above equation and, thus, for instance, $A_o$ is set in accordance with known other parameters.

$$A_o = \frac{A_p}{K_o} \sqrt{\frac{2A_1 A_p(d)}{A_2 M_G}}$$

Thus, $v_o$ is measured in terms of the positioning of land 72 by virtue of $P_{p1} - P_{p2}$ acting on area $A_1$ and the area $A_2$ of the pilot valve piston, and $P_{pC}$ is controlled in terms of the initial velocity $v_o$. Remembering that $P_{pTOT} = P_{p(v_o)} + P_{p(\alpha)}$, it can be seen that the subject system automatically compensates $P_{pTOT}$ for elevation and initial velocity.

Figure 6:
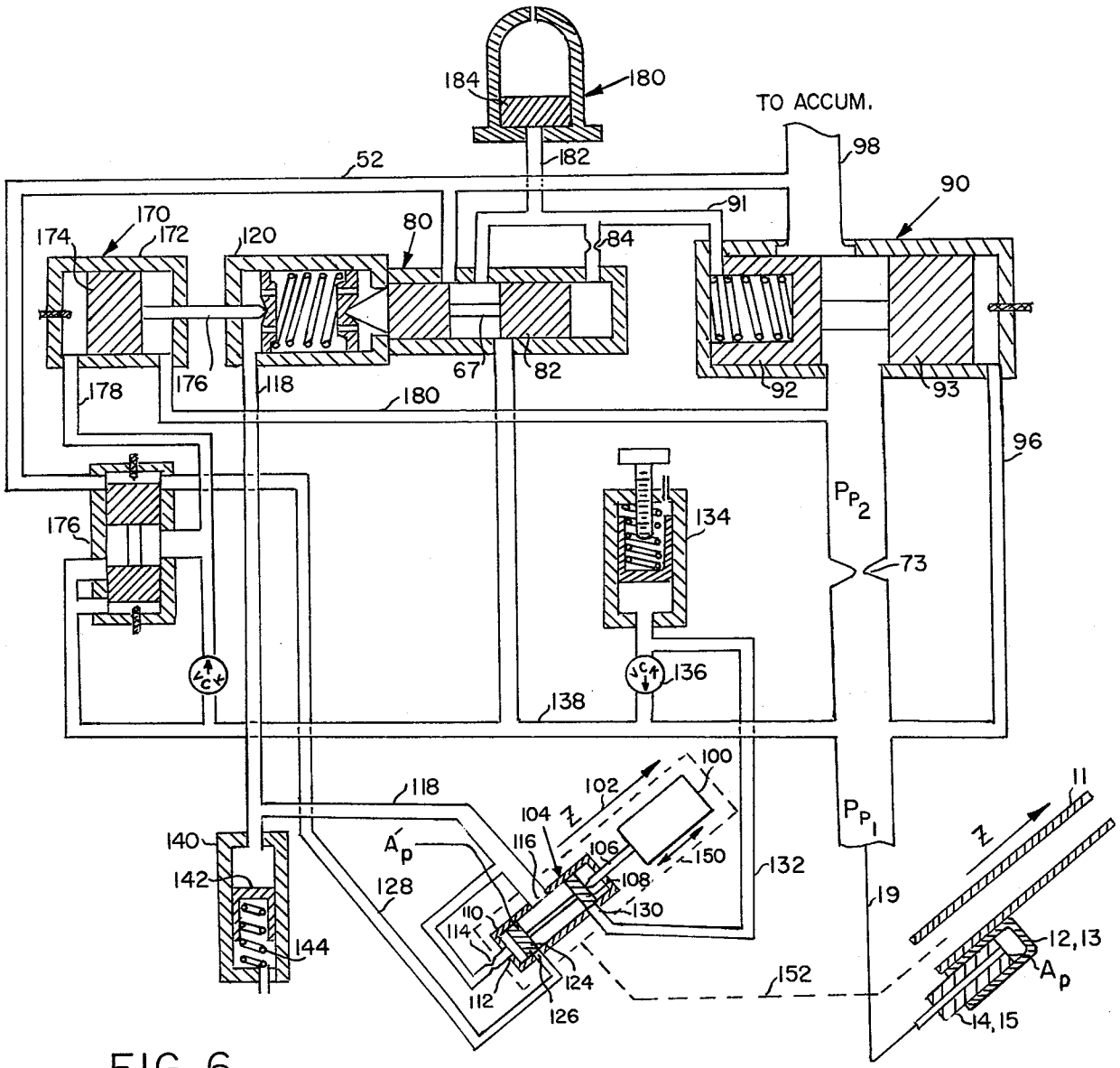
FIG. 6 is a schematic cross section diagram of another embodiment of the subject invention.

Referring now to FIG. 6 an alternative embodiment is described in which the operation of the entire system is improved for various types of specialized situations. While the apparatus hereinbefore described operates adequately for most situations, there are a series of problems which occur for various different types of artillery pieces. For instance, in one type artillery piece there is no valve provided between the accumulator and the rest of the system for turning the accumulator off when firing from the battery position. When no valve is provided and the gun barrel is run out to the battery position the whole system operates at the accumulator pressure. Thus, upon firing, the pressure $P_{p1}$ does not correspond to the elevation pressure but rather to the accumulator pressure. As will be described in FIG. 6, an alternative measure of elevation is provided in which an auxiliary mass is mounted for translation along the same direction as the pointing direction of the gun barrel. A small hydraulic regulator valve is mechanically connected to the auxiliary mass such that the ratio of the auxiliary mass to the area of the regulator valve piston is equal to the ratio of the actual mass of the gun parts subject to recoil divided by the area of the recoil piston. Since the pressure exerted is proportional to Mass, providing a system with the correct ratio for the particular gun, automatically provides the correct pressure for indicating elevation. The output from this regulator valve is utilized, as before, to position a pilot valve in accordance with the sensed elevation.

Another problem with the configuration shown in FIG. 5 is the manufacturing accuracy required of the coaxial valve configuration of valve 70. As will be described in connection with FIG. 6, in order to eliminate the need for the coaxial configuration, the elevation pressure is applied directly to the pilot valve piston and $P_{p1} - P_{p2}$ is utilized to position a single piston.

In several types of artillery pieces, a further problem develops around the five millisecond pressure build-up at firing, in which the piston of the pilot valve has to move rapidly. The pilot valve piston resists this motion, and this resistance is, in part, eliminated by the use of an auxiliary accumulator which absorbs the impulse delivered by the oil or fluid from the recoil pistons during the initial five millisecond pressure build-up. This same accumulator includes a dash-pot which is spring loaded, in which the spring takes the place of one of the two coaxially oriented springs which actuates the pilot valve of FIG. 5.

Another problem in some artillery pieces is that the initial impulse delivered to the control system is quite large and indeed may be so large that the pressure plate at the lefthand side of the main regulator valve may exceed a maximum design value. In order to prohibit this, a relief valve is provided in the line between the pilot valve and the main regulator valve so that should the maximum pressure be exceeded, this pressure can be dissipated.

It will be appreciated that the solutions to the above problems in no way affect the runout controls, and as such, the apparatus illustrated in FIG. 6 relates to the recoil control portion of the system.

Referring now to FIG. 6, in which like reference characters refer to like elements of FIGS. 5 and 6, with respect to the simulated elevation, a mass $M'_G$ illustrated at 100 is provided and is mounted for translation along a direction, *z*, illustrated by arrow 102. Direction *z* is the same direction as that of gun barrel 11. Mass 100 is connected to a small hydraulic regulator valve 104 via a pin 106 which contacts the outer surface of land 108 of the valve. Valve 104 has a housing 110 which is opened at port 112 and a restricted line 114 connects this port to a central port 116 in the housing. Port 116 is connected via a line 118 through a chamber 120 to the lefthand side of pilot valve 80. The lefthand land 124 of valve 104 covers a port 126 which is connected via line 128 to the accumulator. Righthand land 108 covers a port 130 which is connected via line 132 to a low pressure accumulator 134 and to a check valve 136 which couples line 132 to a line 138. Line 118 is also coupled to an auxiliary accumulator 140 which is vented and has a spring loaded dash pot 142.

The elevation sensor portion of the apparatus is illustrated in dotted box 150 and its direction, *z*, is maintained parallel to the axis of the gun barrel via mechanical linkage 152. Alternatively, the entire apparatus may be mounted on the gun stand such that the orientation of the sensing apparatus is automatically maintained parallel to the gun barrel direction.

In operation, as the gun is elevated, mass $M'_G$ bears directly on the hydraulic regulator valve piston with a force $M'_G \sin\theta$, where $\theta$ is the gun elevation. The regulator valve is designed to obtain the following ratio of mass and area:

$$\frac{M_G}{\text{gun piston area, } A_p} = \frac{M_G'}{\text{regulator piston area, } A_p'}$$

This regulator valve automatically produces an output pressure at port 116 which is equal to the pressure in the recoil pistons required to overcome the force of gravity at any angle of elevation of the gun. That is, mass $M'_G$ acting against the pressure established on the lefthand side of valve 104 causes the valve to open proportionally to the gun elevation, such that the pressure at port 116 is equal to $$\frac{M_G \sin\theta}{A_p'} = \frac{M_G \sin\theta}{A_p}.$$

Regulator valve 104 operates as follows: When the gun is elevated, mass $M'_G$ causes land 124 to move to the left, uncovering port 126. Fluid from the main accumulator then is valved to port 116 and thence to pilot valve 80. The resulting backpressure is transmitted through orifice 114 to counteract the pressure exerted by the mass. At equilibrium, the force on land 124 from the backpressure exactly equals the force exerted by the mass, and the pressure of the fluid at port 116 will thus be proportional to the force exerted by mass $M'_G$ on the regulator valve and thus to the elevation. This pressure =

$$\frac{M_G' \sin\theta}{A_p'} = \frac{M_G \sin\theta}{A_p}.$$

So, the pressure in line 118 is the same as that portion of $P_{p_1}$ due to the mass of the gun operating against the fluid in the recoil pistons. When the gun is lowered, mass $M'_G$ moves to the right, allowing land 108 to move to the right. This uncovers port 130 and fluid is returned to the main accumulator.

Low pressure accumulator 134 is used to obtain a low pressure source for the hydraulic regulator valve and still maintain a closed hydraulic system in which there is essentially no loss of hydraulic fluid.

Any time the recoil piston pressure goes below the accumulator 134 pressure, accumulator 134 empties back into the system. Also the piston of accumulator 134 can be manually or electrically forced to discharge back into the closed hydraulic system via check valve 136 on a periodic basis.

Although a specific embodiment to the invention has been described in considerable detail for illustrative purposes, many modifications will occur to those skilled in the art. It is therefore desired that the protection afforded by Letters Patent be limited only by the true scope of the appended claims.

What is claimed is:

1. Apparatus for controlling the recoil of a gun barrel assembly equipped with a hydraulic recoil piston and cylinder so as to cause fluid to flow therefrom during recoil to an accumulator, comprising:

means for measuring the angle of elevation of the gun barrel;

means for measuring the peak recoil velocity of the barrel assembly after firing; and, means for controlling the flow of fluid from the cylinder to the accumulator in accordance with said measured values so as to establish and maintain the deceleration necessary to cause the barrel assembly to have a predetermined velocity at a predetermined distance from the firing position.

2. The apparatus of claim 1 in which the means for measuring of the angle of elevation includes means for measuring the pressure in said recoil cylinder prior to the firing of the gun.

3. The apparatus of claim 1 in which the means for measuring the peak velocity of the barrel assembly includes an orifice in the fluid path between the recoil cylinder and the accumulator, and means for measuring the peak pressure drop across said orifice.

4. Apparatus for controlling the recoil of a gun barrel assembly equipped with a hydraulic recoil piston and cylinder by controlling the fluid flow therefrom during recoil comprising:

means for hydraulically measuring the elevation of the gun barrel;

means for hydraulically measuring the initial velocity of said gun barrel assembly after firing; and, means for controlling the fluid flow from said recoil cylinder in accordance with said hydraulically measured quantities, so as to obtain a predetermined deceleration pressure which insures that the gun barrel assembly will have a predetermined velocity at a predetermined distance from the firing position.

5. The apparatus of claim 4 wherein the said elevation measuring means includes means for measuring the pressure in said recoil cylinder prior to firing said gun.

6. The apparatus of claim 4 wherein said elevation measuring means includes a mass which travels in the same direction as the recoil direction and means for measuring the force exerted by said mass.

7. The apparatus of claim 6 wherein said force measuring means includes a regulator valve actuated by the force of said mass thereon.

8. The apparatus of claim 4 wherein said controlling means includes a main regulating valve in the fluid discharge path from said recoil cylinder to said accumulator;

a pilot valve positioned in accordance with said hydraulically measured quantities; and, means for positioning said main regulating valve by fluid from said pilot valve.

9. Apparatus for controlling the runout and recoil of a gun barrel assembly equipped with a hydraulic recoil piston and cylinder comprising:

an accumulator which provides fluid under pressure;

means for connecting said accumulator to said recoil cylinder; and, means for regulating the fluid flow from and to said accumulator so as to provide a predetermined constant runout velocity and a predetermined velocity at a predetermined distance from the firing position of the gun.

10. The apparatus of claim 9 wherein said regulating means includes a regulating valve between said accumulator and said recoil cylinder, an orifice in the fluid flow path between said regulating valve and said recoil cylinder, and means for adjusting the fluid flow through said regulating valve in accordance with the pressure drop across said orifice.

11. Apparatus for controlling the runout of a gun barrel assembly equipped with a hydraulic recoil piston and cylinder comprising:

an accumulator which provides fluid under pressure;

means for connecting said accumulator to said recoil cylinder; and, means for regulating the fluid flow from said accumulator responsive to the fluid pressure between said accumulator and said recoil cylinder so as to obtain a constant runout velocity.

12. The apparatus of claim 11 wherein said regulating means includes a regulating valve in the fluid flow path from said accumulator to said recoil cylinder; an orifice in the fluid flow path between said regulating valve and said recoil cylinder; and means for controlling the fluid flow through the regulator valve in accordance with the pressure drop across said orifice.

13. The apparatus of claim 12 wherein the size of said orifice controls the runout velocity.

14. Apparatus for controlling the recoil of a gun barrel assembly equipped with a hydraulic recoil piston and cylinder comprising:

an accumulator which provides fluid under pressure;

means for connecting said accumulator to said recoil cylinder; and, means for regulating the fluid flow from said recoil cylinder so as to provide a predetermined velocity at a predetermined distance from the firing position of the gun.

15. A method of controlling the recoil of a gun barrel assembly equipped with a hydraulic recoil piston and cylinder so as to cause fluid to flow therefrom during recoil to an accumulator, comprising the steps of:

measuring the angle of elevation of the gun barrel;

measuring the peak recoil velocity of the barrel assembly after firing, and, controlling the flow of fluid from the recoil cylinder to the accumulator in accordance with the measured quantities so as to establish and maintain the deceleration necessary to cause the barrel assembly to have a predetermined velocity at a predetermined distance from the firing position.

16. The method of claim 15 in which the measuring of the angle of elevation includes the step of measuring the pressure in said recoil cylinder prior to the firing of the gun.

17. The method of claim 15 in which the measuring of the peak velocity includes the step of measuring the peak pressure drop across an orifice in the fluid path between the recoil cylinder and the accumulator.

18. A method of controlling the recoil of a gun barrel assembly equipped with a hydraulic recoil piston and cylinder by controlling the fluid flow therefrom during recoil comprising the steps of:

hydraulically measuring the elevation of the gun barrel, hydraulically measuring the initial velocity of the gun barrel assembly after firing; and, controlling the fluid flow from the recoil cylinder in accordance with said hydraulically measured quantities, so as to obtain a predetermined deceleration pressure which insures that the gun barrel assembly will have a predetermined velocity at a predetermined distance from the firing position.

19. The method of claim 18 wherein the elevation measuring step includes the step of measuring the pressure in the recoil cylinder prior to firing the gun.

20. The method of claim 18 wherein the elevation measuring step includes the step of measuring the force exerted by a mass which travels in the same direction as the recoil direction.

21. The method of claim 18 wherein said controlling step includes the steps of providing a main regulating valve in the fluid discharge path from the hydraulic piston and cylinder; and, controlling the position of the main regulating valve by fluid from a pilot valve positioned in accordance with said hydraulically measured quantities.

22. A method of controlling the runout and recoil of a gun barrel assembly equipped with a hydraulic recoil piston and cylinder comprising the steps of:

providing fluid under pressure from an accumulator to the cylinder; and, regulating the fluid flow from and to the accumulator so as to provide a predetermined constant runout velocity and a predetermined velocity at a predetermined distance from the firing position of the gun.

23. A method of controlling the runout of a gun barrel assembly equipped with a hydraulic recoil piston and cylinder comprising the steps of:

providing fluid under pressure from an accumulator to the recoil cylinder; and, regulating the fluid flow from the accumulator in accordance with fluid pressure between said accumulator and said recoil cylinder so as to obtain a constant runout velocity.

24. The method of claim 23 wherein said regulating step includes the step of providing a regulating valve in the fluid flow path from the accumulator to the recoil cylinder and controlling the fluid flow through the regulator valve in accordance with the pressure drop across an orifice in the fluid flow path between the regulation valve and the recoil cylinder.

25. The method of claim 24 wherein said regulating step further includes the step of controlling the runout velocity by the size of the orifice.

26. A method of controlling the recoil of a gun barrel assembly equipped with a hydraulic recoil piston and cylinder comprising the steps of:

providing fluid under pressure from an accumulator to the recoil cylinder; and, regulating the fluid flow from the recoil cylinder so as to provide a predetermined velocity at a predetermined distance from the firing position of the gun.

27. Apparatus for controlling the recoil of a gun barrel assembly equipped with a hydraulic recoil piston and cylinder so as to cause fluid to flow therefrom during recoil to an accumulator, comprising:

means for trapping the pressure exerted by the gun barrel assembly as a result of gravity acting thereon to measure the angle of elevation of the gun barrel;

an orifice in the fluid path between said recoil cylinder and said accumulator;

means for trapping a pressure representing the peak pressure drop across said orifice caused by the movement of said barrel assembly at the time of firing to measure the peak recoil velocity of the barrel after firing; and, means for controlling the flow of fluid from said recoil cylinder to said accumulator in accordance with said trapped pressures so as to establish and maintain the deceleration necessary to cause the barrel to have a predetermined velocity at a predetermined distance from the firing position.

28. Apparatus for controlling the recoil of a gun barrel assembly equipped with a hydraulic recoil piston and cylinder by controlling the fluid flow therefrom during recoil comprising:

means for hydraulically measuring the elevation of the gun barrel;

means for hydraulically measuring the initial velocity of said gun barrel assembly immediately after firing; and, means for controlling the fluid flow from said hydraulic recoil piston and cylinder in accordance with said hydraulically measured quantities, so as to obtain a predetermined deceleration pressure which insures that the gun barrel assembly will have a predetermined velocity at a predetermined distance from the firing position, said controlling means including a main regulating valve in the fluid discharge path from said recoil cylinder to said accumulator; a pilot valve connected in parallel with said main regulating valve and positioned in accordance with said hydraulically measured quantities and, means for positioning said main regulating valve by fluid from said pilot valve.

29. The apparatus of claim 28 wherein said pilot valve includes a spool assembly and wherein said controlling means includes means for exerting a force on one end of said spool assembly proportional to said hydraulically measured quantities.

30. The apparatus of claim 29 wherein each of said measuring means includes a hydraulic actuator which exerts a force on said one end of said spool assembly.

31. The apparatus of claim 30 wherein said hydraulic actuators include spring means for exerting a force on said one end of said spool assembly.

32. The apparatus of claim 29 wherein said initial velocity measuring means includes a hydraulic actuator for exerting a force on said one end of said spool assembly indicative of said initial velocity and wherein said elevation measuring means includes means for supplying fluid to said one end of said spool assembly at a pressure indicative of said elevation angle.

33. The apparatus of claim 29 wherein each of said measuring means includes means for exerting a force on said one end of said spool assembly proportional respectively to the pressure in said recoil cylinder created by the force of gravity on said barrel assembly and the square of the initial velocity at the time of firing.

34. The apparatus of claim 33 wherein said elevation measuring means includes an orifice in the flow path between said pilot valve and said recoil cylinder and wherein the square of the initial velocity is measured by the differential pressure across said orifice.

35. Apparatus for controlling the runout of a gun barrel assembly equipped with a hydraulic recoil system and cylinder comprising:

an accumulator which provides fluid under pressure;

means for connecting said accumulator to said recoil cylinder; and, means for regulating the fluid flow from said accumulator so as to obtain a constant runout velocity, said regulating means including a regulating valve in the fluid flow path from said accumulator to said recoil cylinder; an orifice in the fluid flow path between said regulating valve and said recoil cylinder; and means for controlling the fluid flow through the regulator valve in accordance with the pressure drop across said orifice.

36. The apparatus of claim 35 wherein the size of said orifice controls the runout velocity.

37. A method of controlling the runout of a gun barrel assembly equipped with a hydraulic recoil piston and cylinder comprising the steps of:

providing fluid under pressure from an accumulator to the recoil cylinder; and, regulating the fluid flow from the accumulator so as to obtain a constant runout velocity, said regulating step including the step of providing a regulating valve in the fluid flow path from the accumulator to the recoil cylinder and controlling the fluid flow through the regulating valve in accordance with the pressure drop across an orifice in the fluid flow path between the regulating valve and the recoil cylinder.

38. The method of claim 37 wherein said regulating step further includes the step of controlling the runout velocity by the size of the orifice.

* * * * *